United States Patent [19]

Jernstrom et al.

[11] 4,323,238

[45] Apr. 6, 1982

[54] ACTION TOY REQUIRING SPACE PERCEPTION AND EYE/HAND COORDINATION

[75] Inventors: Hans E. I. Jernstrom, Barrington; Thomas L. Long, Arlington Heights; Ronald Liedtke, Addison, all of Ill.

[73] Assignee: Jernstrom Design Workshop, Inc., Palatine, Ill.

[21] Appl. No.: 236,790

[22] Filed: Feb. 23, 1981

[51] Int. Cl.[3] ..... A63F 9/06

[52] U.S. Cl. ..... 273/1 G; 434/259; 46/145

[58] Field of Search ..... 273/1 G, 1 R, 1 GC, 273/1 GD, 1 E, 1 M, 1 GF; 434/259; 46/145, 146

[56] References Cited

U.S. PATENT DOCUMENTS

| | | | |
|---|---|---|---|
| 1,089,229 | 3/1914 | Klein | 46/145 |
| 2,623,303 | 12/1952 | Mindel | 434/259 |
| 2,911,740 | 11/1959 | Miller | 434/259 |
| 3,630,520 | 12/1971 | Cooper | 273/1 R |
| 3,710,455 | 1/1973 | Liversidge et al. | 434/259 |
| 3,760,511 | 9/1973 | Matsumoto | 434/259 |
| 3,961,794 | 6/1976 | Goldfarb et al. | 434/259 X |
| 4,149,717 | 4/1979 | Seijiro | 434/259 X |
| 4,163,560 | 8/1979 | Solomon | 434/259 X |
| 4,169,593 | 10/1979 | Wood | 273/1 GF |
| 4,246,719 | 1/1981 | Kulesza et al. | 46/145 X |

*Primary Examiner*—Paul E. Shapiro

*Attorney, Agent, or Firm*—Laff, Whitesel, Conte & Saret

[57] ABSTRACT

A toy has an enclosure pierced by a plurality of holes, each hole being in the shape of a distinctive geometry. A plurality of blocks are shaped to pass through only individually associated ones of the holes. Inside the housing, a balanced panel receives the blocks as they pass through the holes. When the cumulative weight of all blocks on the panel equals or exceeds a spring bias, the balance panel tips and performs a surprise function. In the disclosed embodiment, the surprise is a toy cow popping through a door and the blocks discharged out the back is both a surprise and a reward.

12 Claims, 7 Drawing Figures

ACTION TOY REQUIRING SPACE PERCEPTION AND EYE/HAND COORDINATION

This invention relates to surprise action toys for small children and, more particularly, to toys having action and movement responsive to successive eye/hand coordinations, coupled with visual perception.

Small children like to be both surprised and rewarded for achievements. As they grow, achievements are largely determined by the particular place where the child is on its learning curve. For example, at one age, the child learns to relate different geometrical shapes. About the same time, the child is also learning to pick up objects and to orient them. Animals are attracting their attention at about the same time. Thus, a child's interests in all of these things tend to come together at about the same time.

There are, of course, many toys which appeal to a child at this age. However, the child's interest span is also quite short at this age and, therefore, he soon loses interest. Accordingly, it becomes difficult to design toys which accomplish all of the foregoing goals while simultaneously maintaining the child's interest over extended periods of time.

Accordingly, an object of the invention is to provide new and improved action toys. Here, an object is to provide a combination of designs and features which attract and hold a child's attention for longer periods of time.

In keeping with an aspect of the invention, these and other objects are accomplished by providing a toy having a plurality of distinctively-shaped cutouts which correspond to the cross section of blocks. Inside the toy, there is a spring-biased platform which control a latch that locks or unlocks trapdoors. The child inserts the blocks through their matching cut outs and they fall onto the platform. When a combination of inserted blocks reach a total weight (or the weight plus the force of impact) which exceeds a spring bias, the platform tips and the trapdoors are released to surprise the child. In the embodiment described, one trapdoor opens to enable a cow to pop out while another door opens to return the blocks to the child.

A preferred embodiment of the invention is shown in the attached prints wherein.

Figure 1:
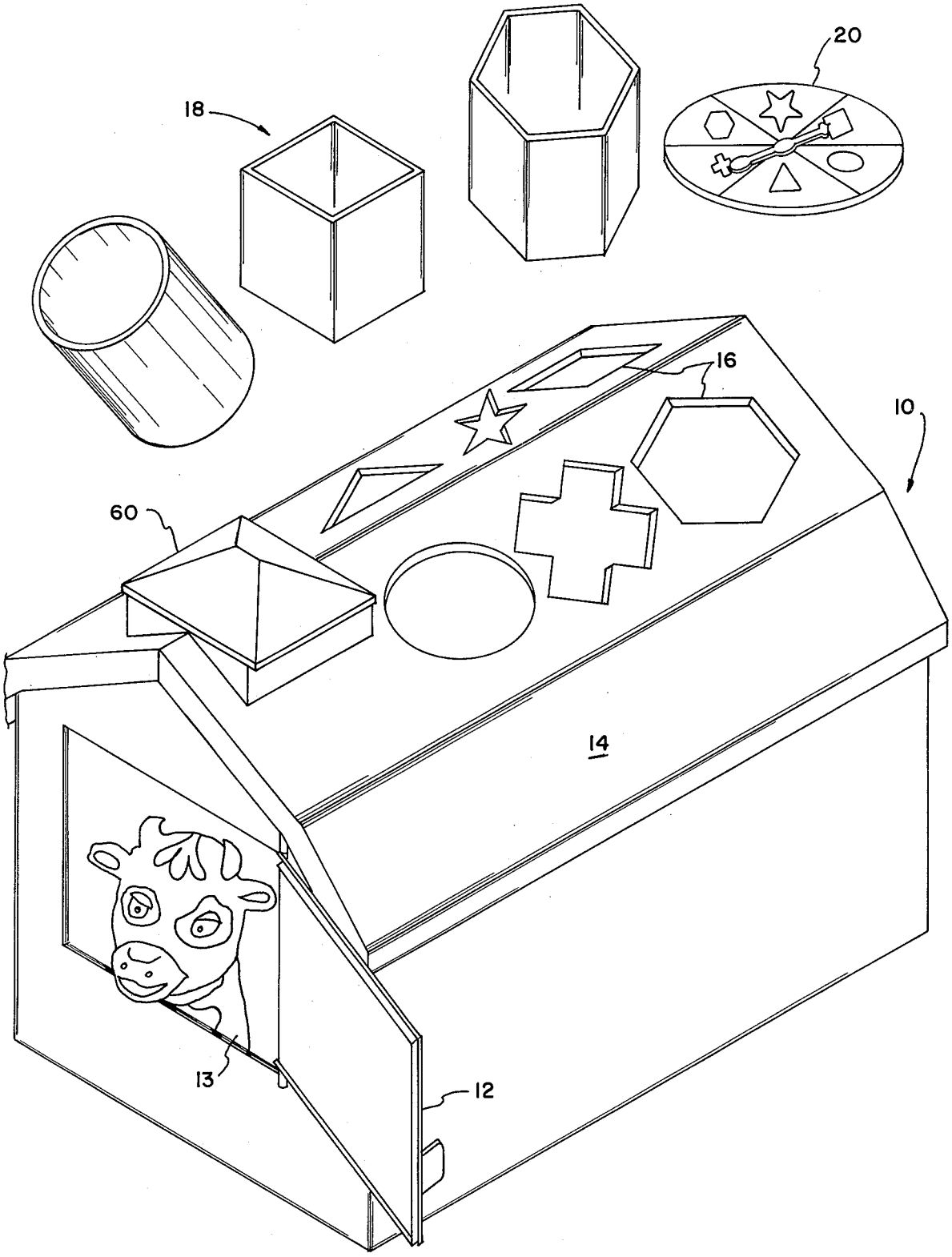
FIG. 1 is a perspective view of the inventive toy.

In FIG. 1, a barn 10 has a normally closed front door 12 which is here shown in an opened position to expose a displaceable part (here, in the form of cow 13) that moves forward to look out of a stall. By way of example, the barn is shown as having a gambrel or Dutch roof 14 pierced by a number of roof holes or cutouts 16, each having a different geometrical design. A number of blocks 18 have cross sections which exactly match the designs of the roof holes 16 so that each block fits through one and only one roof hole. A spinner 20 enables the child to select a particular shape, and then he has to match the shape of the spinner-selected block with a corresponding shape of a roof hole.

The door 12 is closed and a child places the blocks having distinctive cross sections in the matching cutouts by depositing them through the roof holes. When enough blocks have been so deposited, the door 12 pops open and the cow 13 looks out. There is an element of surprise since the force with which the blocks are deposited and strike the platform affects how soon the door opens. Also, the spinner 20 makes it a game since the spinner may point at a previously selected shape and thus give one player an advantage over another player.

The principal components inside the barn 10 are shown in FIGS. 2–5. There is a vertical panel 24 having a center latch hole 26 near its top edge. A preferably soft, molded rubber head of a toy cow is mounted on panel 24 in a position when it looks out of the door, if it is opened. The bottom of the panel has two opposed pegs 28, 30 which serve as hinge pins for the door. Springs 32, 34 wrap around the pegs 28, 30 and bias the panel 24 to swing toward the door 12.

Behind the panel 24, there is a generally Y-shaped lever member 38 having a pair of arms 40 on one end and a generally "T" configuration 42 on the other end. The arms 40 snap through matching holes in panel 24 so that the panel 24 and lever member 38 can pivot relative to each other. The "T" configuration 42 has opposed posts which are captured by and slide in grooves near the center of a floor at the back of barn 10. As the panel 24 swings forward, the "T" configuration 42 also slides forward (FIG. 5), as the panel 24 swings back into the barn (FIG. 4), the "T" configurations slides back.

A second part inside the barn is an inclined, spring biased panel 46 having a pair of opposed pegs 48, 50 which function as hinge pins. The forward end 52 of the panel 46 projects beyond hinge pins 48, 50 and carries a circular embossment 54. A coiled spring 56 (FIGS. 4, 5) fits between the embossment 54 and a spring seat 58 formed in the roof under a cupola 60 (FIG. 1). The spring 56 biases end 52 of panel 46 to urge it to swing downwardly in direction A, thereby causing the opposite end to swing upwardly in direction B. A post 64 is formed on the opposite end of panel 46 (FIG. 3) to fit through slot 66 in the side wall of barn 10. Under the bias of spring 56, the panel 46 rotates in direction B about hinge pin pegs 48, 50 as far as permitted by peg 64 riding in capture slot 66. When the panel 46 rotates in direction C, the downward excursion is limited by pin 64 reaching the bottom end of slot 66.

Peg 64 projects out of the side wall far enough for the child to find and manipulate it. The manipulation operates the toy without requiring the blocks to be deposited. Thus, it is a feature for the child to find and learn how to manipulate.

Figure 4:
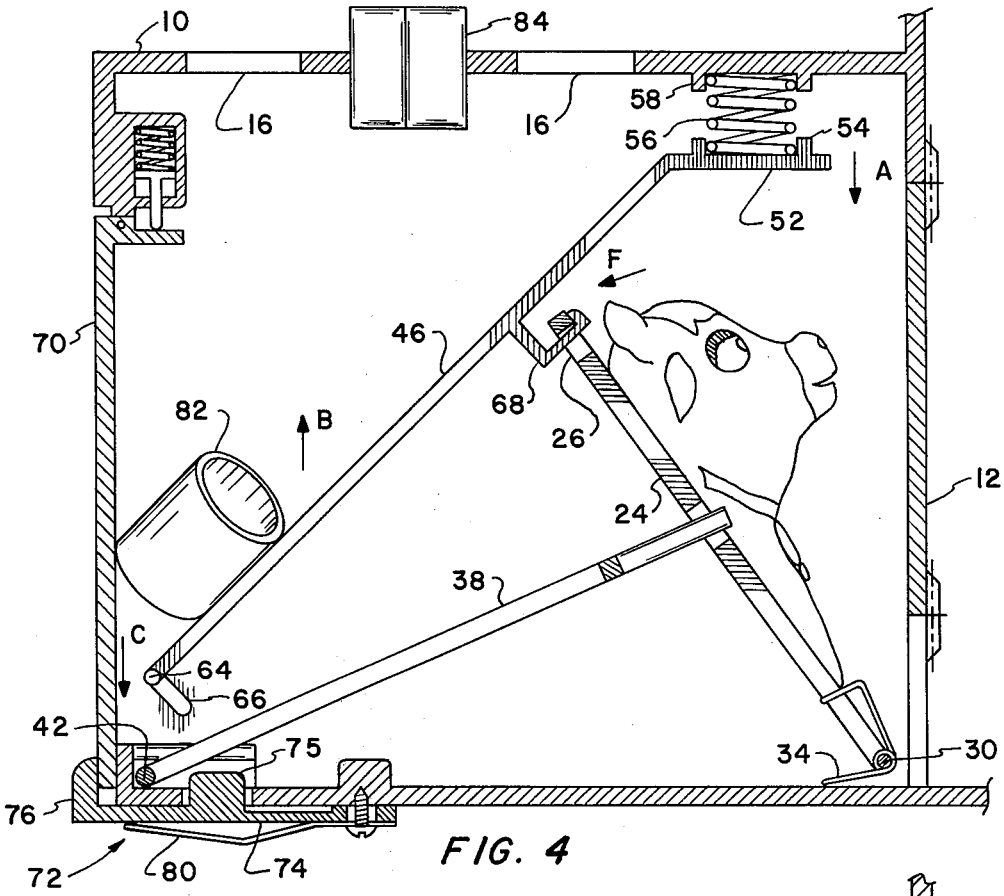
FIG. 4 is a side elevation, cross-sectional view showing the toy in a cocked position.
Figure 5:
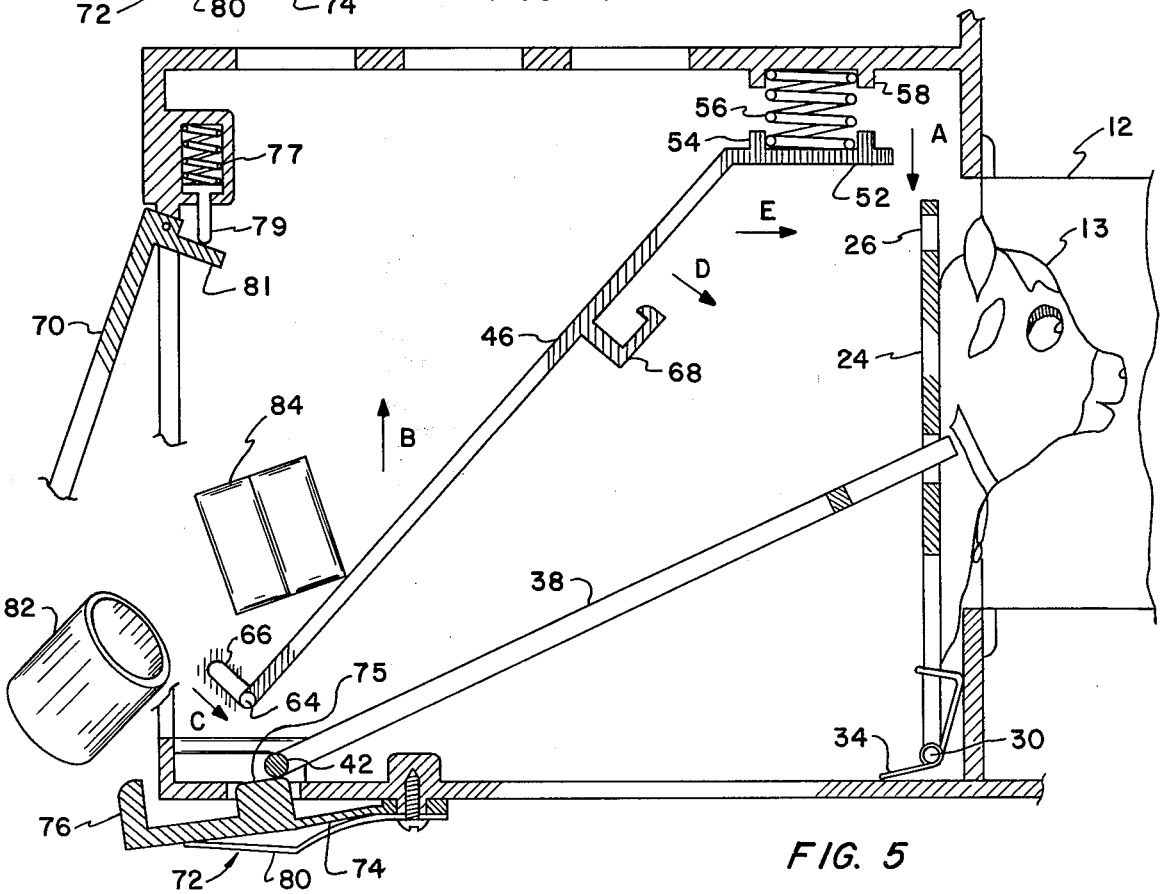
FIG. 5 is a similar side elevation cross-sectional view showing the toy in the open position.

Dependent from panel 46 is a hook 68 which is positioned to engage hole 26 in the top edge of panel 24. When panel 24 is pushed back through open door 12, the end of dependent latch 68 passes through hole 26. The bias of spring 56 enables the latch 68 to move slightly and capture the panel 24. As soon as the hook 68 passes through the hole 26, the bias of spring 56 lifts the hook 68 to capture the panel 24. The cow 13 is now completely within the barn and the front door 12 may be swung shut, as shown in FIG. 4.

Figure 7:
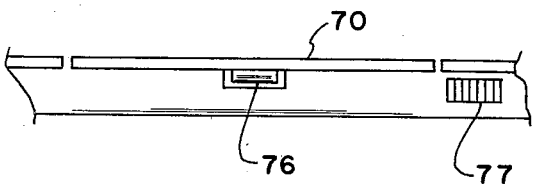
FIG. 7 is a fragmentary view of a trapdoor and latch mechanism.
Figure 2:
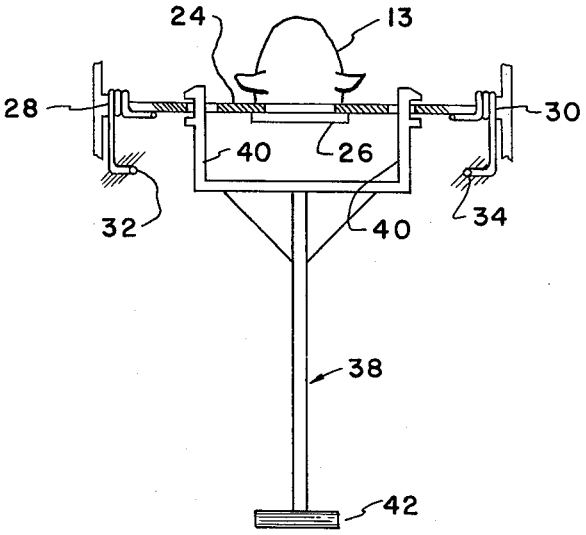
FIG. 2 is a top plan view of a trapdoor and control lever system which is actuated by a spring-biased platform that trips when a suitable number of blocks have been deposited.
Figure 3:
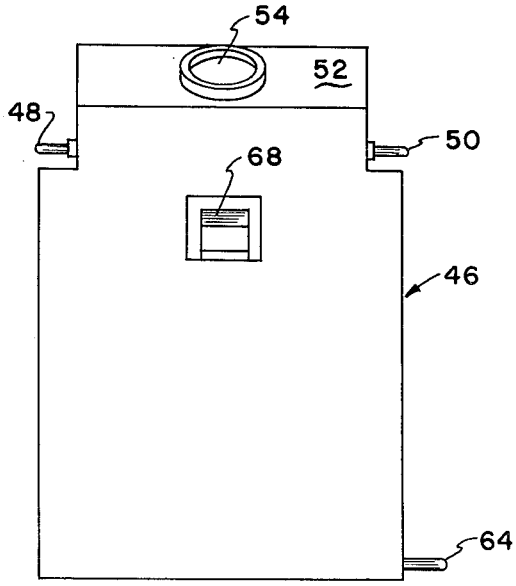
FIG. 3 is a plan view of the spring-biased platform.

A second trapdoor 70 (FIGS. 4, 5, 7) is hinged to the back of barn 10, for holding or releasing blocks which are dropped through the roof holes. The trapdoor 70 is held in a closed position by a cantilever leaf spring biased latch assembly 72. This assembly 72 includes an elongated plastic piecepart 74 which is flexible enough to bend somewhat along its length, without damage. At its outer end, the plastic part 74 has a latch 76 to capture and hold door 70 shut. An actuating tab 75 is formed along the length of piece part 74, in the path of the rear end of the Y-shaped lever member 38. A sliding member 77 (FIG. 7) locks the door independently of latch 76, for storage of the toy. (The latch 77 slides away from its locking position in front of the door, for usage.)

When the panel 24 moves forward, the rear end of Y-shaped member 38 also moves forward over tab 75 to depress plastic member 74. The arms 42 of the "T" configuration are held down by a guide groove formed in the floor of the barn. Therefore, tab 75 must go down and arm 38 cannot move up, thereby removing the latch 76 that is holding door 70 shut. A metal leaf spring 80 gives resilience, tension and strength to the plastic member 74. When latch 76 releases the door, spring 77 pushes follower 79 against lever 81 to open door 70 and thereby releases blocks 82, 84.

In operation, door 70 is pushed toward the barn 10 and captured behind latch 76. Panel 24 is pushed into the barn and hook 68 passes through the opening 26 to capture the panel. The front door 12 is then closed. The barn is now in the condition seen in FIG. 4.

The child either pushes or drops blocks 18 through the roof holes. For example, a block 82 is shown as already having passed through a roof hole and is now lying on panel 46 while a second block 84 is seen as being in the process of passing through a roof hole. As each block falls on panel 46, it adds its own weight to the weight of other blocks accumulated there. If the child pushes the block forcefully, the added impact of the falling block effectively increases the weight for a moment, to add to the total accumulated weight of the blocks.

At some time, the total weight of all deposited blocks and the momentary force of the impact exceed the constant of spring 56. Then, the panel pivots around arms 48, 50. Hook 68 moves in direction D and releases panel 24.

Springs 32, 34 force the panel 24 to move forward in direction E, when hook 68 slips through hole 26. The cow 13 pushes door 12 open and is seen by the child. As panel 24 moves forward in direction E, the Y-shaped lever member 38 is pulled forward. The rear end of member 38 depresses tab 75 to lower latch 76 and release door 70. The weight of all blocks 82, 84 is resting against door 70, which opens.

The blocks fall through open door 70 and off the panel 46. When the weight of the blocks disappears, spring 56 pushes panel in direction A (FIG. 4). Panel 24 is manually pushed in direction F and hooked onto hook 68. The rear end of Y-shaped lever member 38 moves off the tab 76. Back door 70 is manually pushed and snaps behind latch 76. Door 12 is closed and the toy is now in the condition of FIG. 4 and ready for the next operation.

Figure 6:
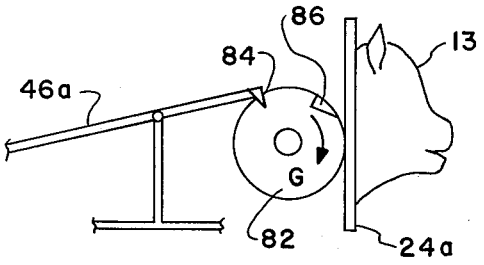
FIG. 6 is a fragmentary view of a second embodiment of the invention.

An alternative embodiment is seen in FIG. 6. There, the panel 24 is mounted on and affixed to a spring-biased wheel 82 which is urged to rotate in direction G. The panel **46*a* has a notch 86 which is engaged by hook 84 to capture the wheel 82 in a position where the cow is completely within the barn. When the top of panel 24 is pushed, wheel 82 turns in a direction opposite to the direction G until the hook 84 falls into notch 86. The wheel 82** is then held against the bias of a spring.

When there is a sufficient weight of blocks resting on panel **46*a*, the hook 84 is lifted out of notch 86. The spring bias acting on the wheel 82 rolls the panel 24 forward and cow 13** looks out of the front door.

Those who are skilled in the art will readily perceive how to modify the system. Therefore, the appended claims are to be construed to cover all equivalent structures which fall within the true scope and spirit of the invention.

We claim:

1. A toy comprising an enclosure pierced by a plurality of holes of distinctive geometry, a plurality of objects shaped to pass through individually associated ones of said distinctive holes, balance means inside said housing for receiving said objects as they pass through said holes, said balance means balancing the total weight of the received objects against a spring bias, and means responsive to a cumulative weight of all objects on said balancing means exceeding said bias for performing a surprise function with said toy.

2. The toy of claim 1 and a displaceable part means operated responsive to said balancing means for moving between non-exposed positions and exposed positions in order to perform said surprise function.

3. The toy of claim 2 wherein said displaceable part means comprises a panel hinged at one side and spring-biased to move outwardly from the interior of said enclosure, and means on said balance means for normally holding said panel at an interior location, said panel holding being released when said weight on said balancing means exceeds said bias.

4. The toy of claim 3 and door means for concealed said panel from view while it is being held by said balancing means, said door means being pushed open to reveal said panel responsive to the release of said holding means.

5. The toy of claim 4 wherein said panel carries the head of an animal which appears to be looking out of said door when open.

6. The toy of any one of the claims 1–5 and second door means for releasing said objects when said balancing means move against said spring bias.

7. The toy of claim 6 and chance means for selecting one of said distinctive geometrical holes.

8. The toy of claim 6 and latch means for normally holding said second door means shut, and means for selectively operating said latch means responsive to movement of said displaceable means outwardly.

9. The toy of claim 8 and chance means for selecting one of said distinctive geometrical holes.

10. A toy having a generally box-shaped member with two doors, animal-representing means inside one of said doors, distinctive geometry means for selectively opening said doors with an element of surprise when said distinctive geometry is adaquately matched, means responsive to the opening of one of said doors for exposing said animal, and means responsive to the opening of the other of said doors for enabling a resetting of said toy.

11. The toy of claim 10 and means for manipulating said doors without requiring any matching of the distinctive geometrical means.

12. A method of entertaining comprising the steps of:

(a) cocking a toy against at least one spring bias;

(b) matching distinctive geometrical shapes of a plurality of different objects and holes;

(c) detecting when a predetermined number of said shapes are matched;

(d) releasing said cocked toy to enable movement responsive to said spring bias; and (e) performing a surprising display function responsive to said movement.

* * * * *